US010403460B2

(12) United States Patent
Daikoku et al.

(10) Patent No.: US 10,403,460 B2
(45) Date of Patent: Sep. 3, 2019

(54) ELECTROMAGNETIC RELAY

(71) Applicant: PANASONIC INTELLECTUAL PROPERTY MANAGEMENT CO., LTD., Osaka (JP)

(72) Inventors: Kazushige Daikoku, Tochigi (JP); Sota Nishimura, Tochigi (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 78 days.

(21) Appl. No.: 15/838,927

(22) Filed: Dec. 12, 2017

(65) Prior Publication Data

US 2018/0166240 A1 Jun. 14, 2018

(30) Foreign Application Priority Data

Dec. 14, 2016 (JP) ..... 2016-242262
Oct. 16, 2017 (JP) ..... 2017-200183

(51) Int. Cl.

| | |
|---|---|
| ***H01H 50/60*** | (2006.01) |
| ***H01H 50/02*** | (2006.01) |
| ***H01H 51/22*** | (2006.01) |
| ***H01H 51/29*** | (2006.01) |
| ***H01H 50/14*** | (2006.01) |

(Continued)

(52) U.S. Cl.

CPC ..... *H01H 50/60* (2013.01); *H01H 50/02* (2013.01); *H01H 50/026* (2013.01); *H01H 50/04* (2013.01); *H01H 50/043* (2013.01); *H01H 50/14* (2013.01); *H01H 50/58* (2013.01); *H01H 51/22* (2013.01); *H01H 51/229* (2013.01); *H01H 51/29* (2013.01); *H01H 1/2066* (2013.01); *H01H 50/023* (2013.01); *H01H 50/546* (2013.01); *H01H 50/56* (2013.01); *H01H 2050/028* (2013.01)

(58) Field of Classification Search

CPC .... H01H 1/2066; H01H 50/02; H01H 50/026; H01H 2050/028; H01H 50/023; H01H 50/04; H01H 50/043; H01H 50/14; H01H 50/546; H01H 50/56; H01H 50/58; H01H 51/22; H01H 51/229; H01H 51/29

See application file for complete search history.

(56) References Cited

U.S. PATENT DOCUMENTS

2011/0121926 A1 5/2011 Kojima et al.

FOREIGN PATENT DOCUMENTS

JP 2009-289678 12/2009

*Primary Examiner* — Ramon M Barrera

(74) *Attorney, Agent, or Firm* — Greenblum & Bernstein, P.L.C.

(57) ABSTRACT

An electromagnetic relay includes: a fixed terminal including a fixed terminal main body extending in a first direction, a fixed terminal arm portion, and two fixed contacts; a movable spring including two movable contacts, and extending in a second direction; a backstop; and a fixed terminal retainer. One of the fixed terminal main body and the fixed terminal arm portion is a first side terminal portion facing in the second direction, and the other is a second side terminal portion curving from a first edge of the first side terminal portion in a direction opposite to the second direction. A leg portion of the backstop is provided away from the first side terminal portion in the direction opposite to the second direction, and is provided between the two movable contacts on a projection plane with a perpendicular extending in the second direction when viewed from the first direction.

17 Claims, 14 Drawing Sheets

(51) Int. Cl.

| | |
|---|---|
| ***H01H 50/04*** | (2006.01) |
| ***H01H 50/58*** | (2006.01) |
| *H01H 1/20* | (2006.01) |
| *H01H 50/56* | (2006.01) |
| *H01H 50/54* | (2006.01) |

ELECTROMAGNETIC RELAY

BACKGROUND OF THE INVENTION

1. Technical Field

The present disclosure relates to an electromagnetic relay.

2. Related Art

An electromagnetic relay is an electronic part which turns on or off an electric current by closing or opening a set(s) of movable and fixed contacts housed in its cover. In recent years, there has been a demand for electromagnetic relays to have a higher current carrying capacity.

In response, Japanese Patent Application Publication No. 2009-289678 discloses an electromagnetic relay which enhances its compactness, current carrying capacity, and insulation between fixed terminals and a backstop by devising things such as the shape of the backstop which comes in contact with a movable spring including movable contacts.

SUMMARY OF THE INVENTION

The electromagnetic relay according to Japanese Patent Application Publication No. 2009-289678 can obtain a certain high level of current carrying capacity. If the electromagnetic relay according to Japanese Patent Application Publication No. 2009-289678 is employed in order to obtain a higher current carrying capacity, the sizes of the fixed terminal and the like need to be increased. As a result, the size of the electromagnetic relay as a whole becomes larger. In recent years, there has been a demand for not only a higher current carrying capacity but also a decrease in the size while avoiding deterioration in performance of the electromagnetic relay. In this context, a further improvement to the electromagnetic relay is awaited.

The present disclosure has been made in view of the above problem. An object of the present disclosure is to provide an electromagnetic relay which is advantageous to achieve a higher current carrying capacity and a reduction in the size at the same time.

One aspect of the present disclosure is an electromagnetic relay including: an electromagnetic device including a coil; a fixed terminal including a fixed terminal main body extending in a first direction, a fixed terminal arm portion curving and continuing from an edge of the fixed terminal main body, and two fixed contacts; a movable spring including two movable contacts which come into or out of contact with the two fixed contacts, extending in a second direction, and being movable by drive of the electromagnetic device; a backstop including a restraint portion provided contactable to a surface opposite from a contact abutment-side surface, an arm portion provided with the restraint portion, and a leg portion curving from the arm portion to a contact-abutment side in the first direction; and a fixed terminal retainer which retains the fixed terminal and the backstop. One of the fixed terminal main body and the fixed terminal arm portion is a first side terminal portion facing in the second direction. Another of the fixed terminal main body and the fixed terminal arm portion is a second side terminal portion curving from a first edge of the first side terminal portion in a direction opposite to the second direction. The leg portion of the backstop is provided away from the first side terminal portion in the direction opposite to the second direction, and provided between the two movable contacts on a projection plane with a perpendicular extending in the second direction when viewed from the first direction.

BRIEF DESCRIPTIONS OF THE DRAWINGS

The figures depict one or more implementations in accordance with the present teaching, by way of example only, not by way of limitations. In the figures, like reference numerals refer to the same or similar elements.

DETAILED DESCRIPTION

Embodiments of the present disclosure will be described below with reference to the drawings. In the following descriptions, as an example, a first direction, a second direction and a third direction are defined as follows. First of all, the first direction in which connecting terminals extend is defined as a Z direction. The Z direction is a direction toward the inside of the electromagnetic relay from a side of the electromagnetic relay from which the connecting terminal is exposed to the outside of the electromagnetic relay. The direction in which the distal end of the connecting terminal is exposed to the outside of the electromagnetic relay is the lower side. Furthermore, an X direction and a Y direction are defined as being perpendicular to each other on a plane perpendicular to the Z direction. Particularly, a second direction in which a later-discussed movable spring 30*b* extends is defined as the X direction. In addition, a third direction in which later-discussed two movable contacts 33 or two fixed contacts 44 are arranged side-by-side is defined as the Y direction.

First Embodiment

Figure 1:
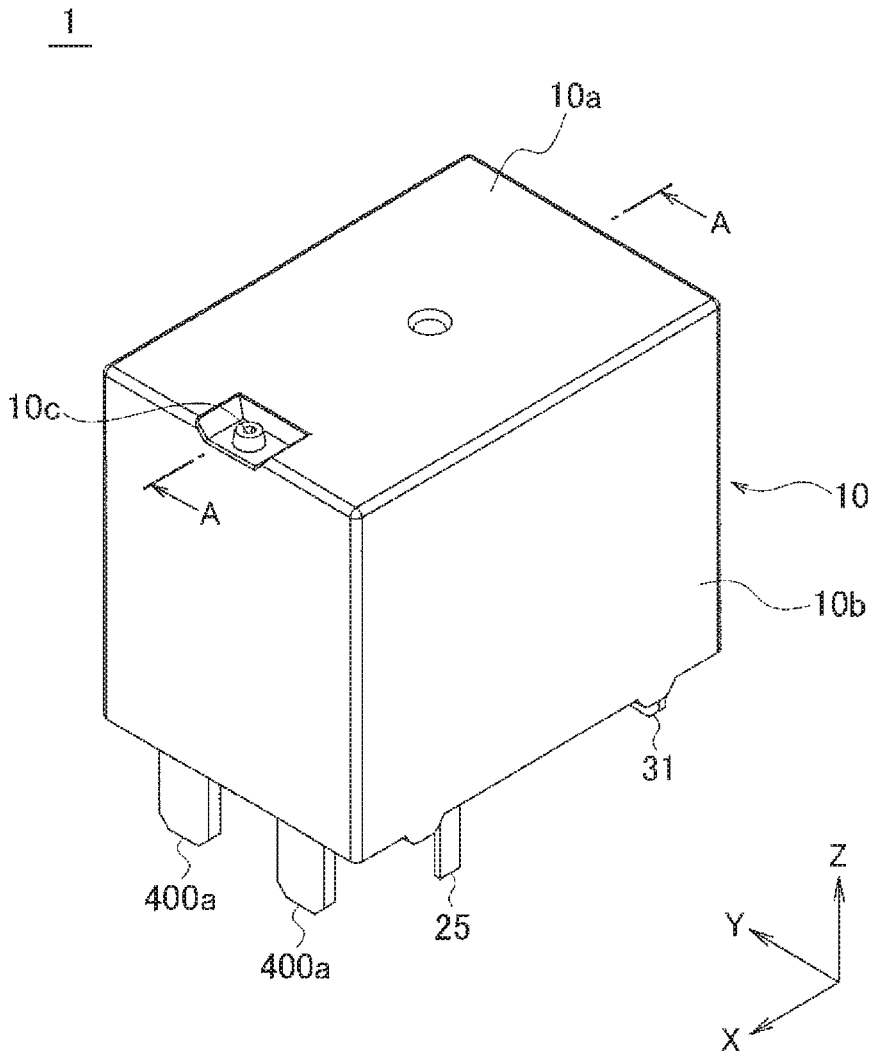
FIG. 1 is a view illustrating an external appearance of an electromagnetic relay according to an embodiment.
Figure 2:
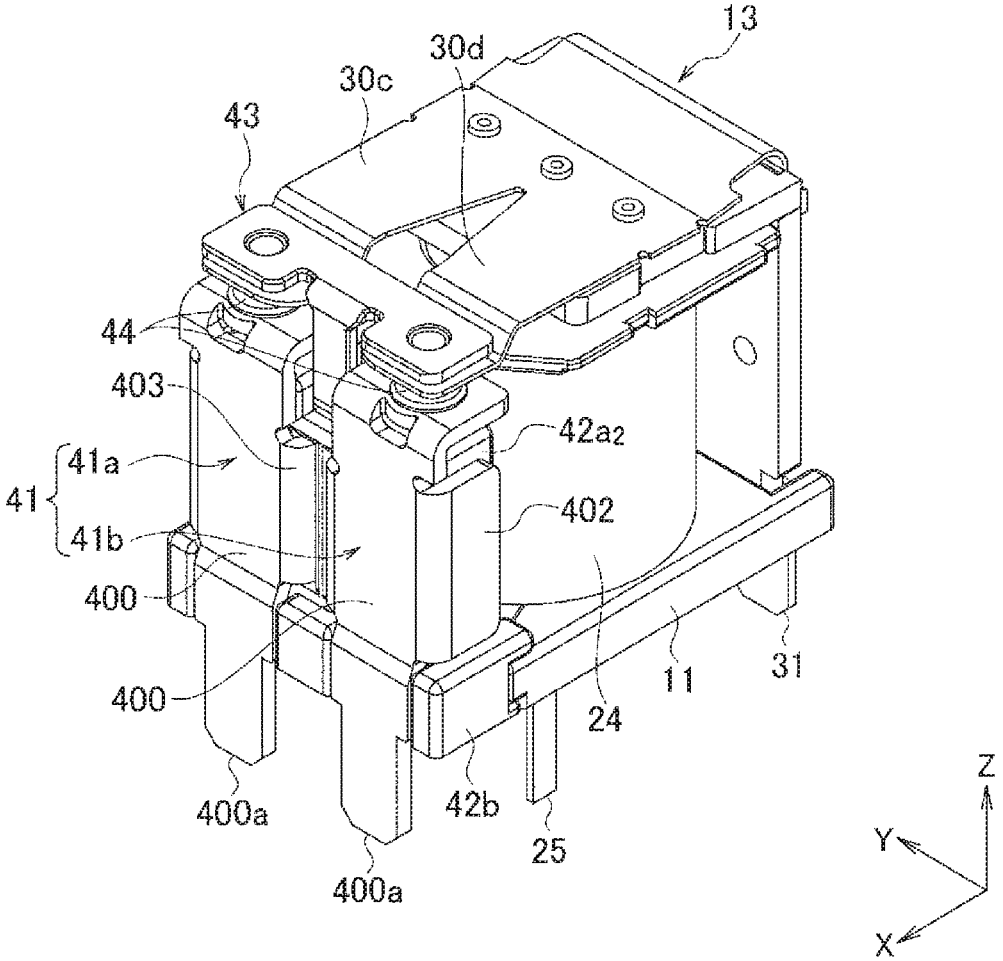
FIG. 2 is a view illustrating an internal configuration of the electromagnetic relay according to the embodiment.
Figure 3:
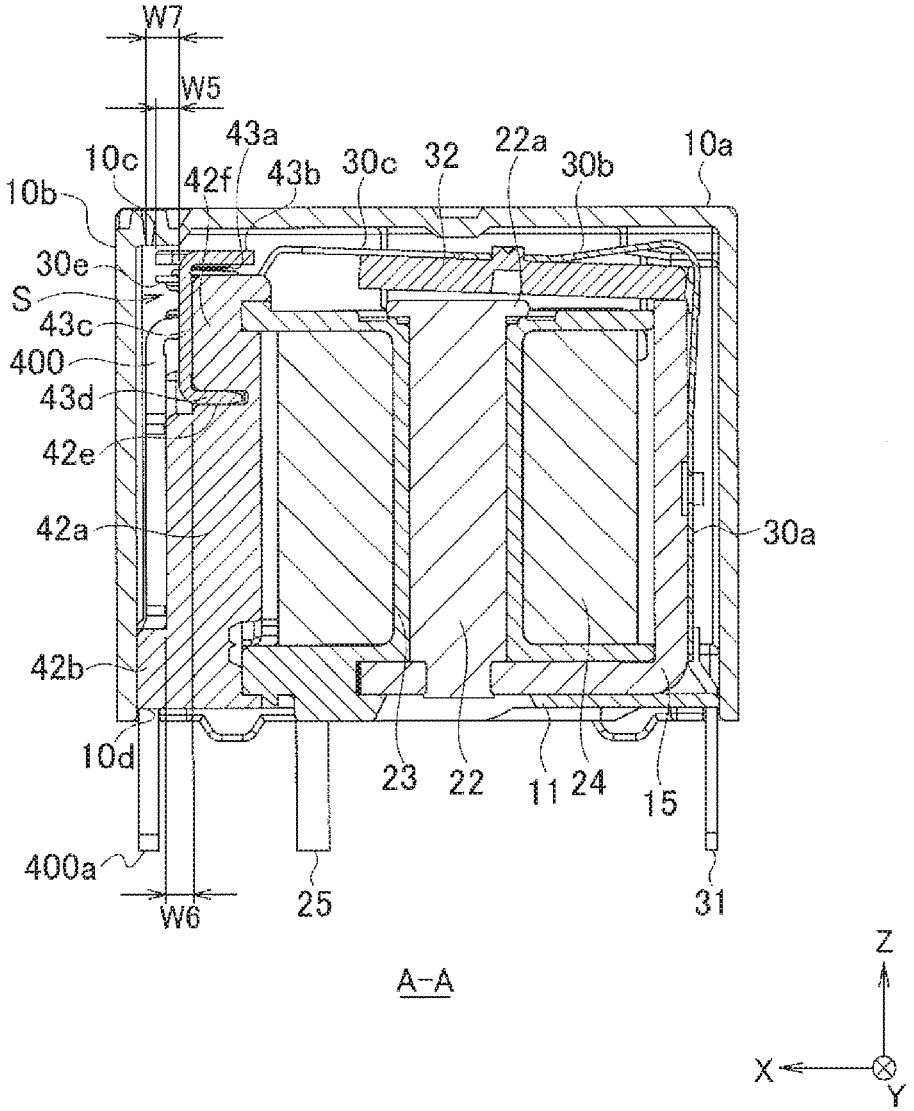
FIG. 3 is a cross-sectional view of the electromagnetic relay taken along the A-A line in FIG. 1.
Figure 4:
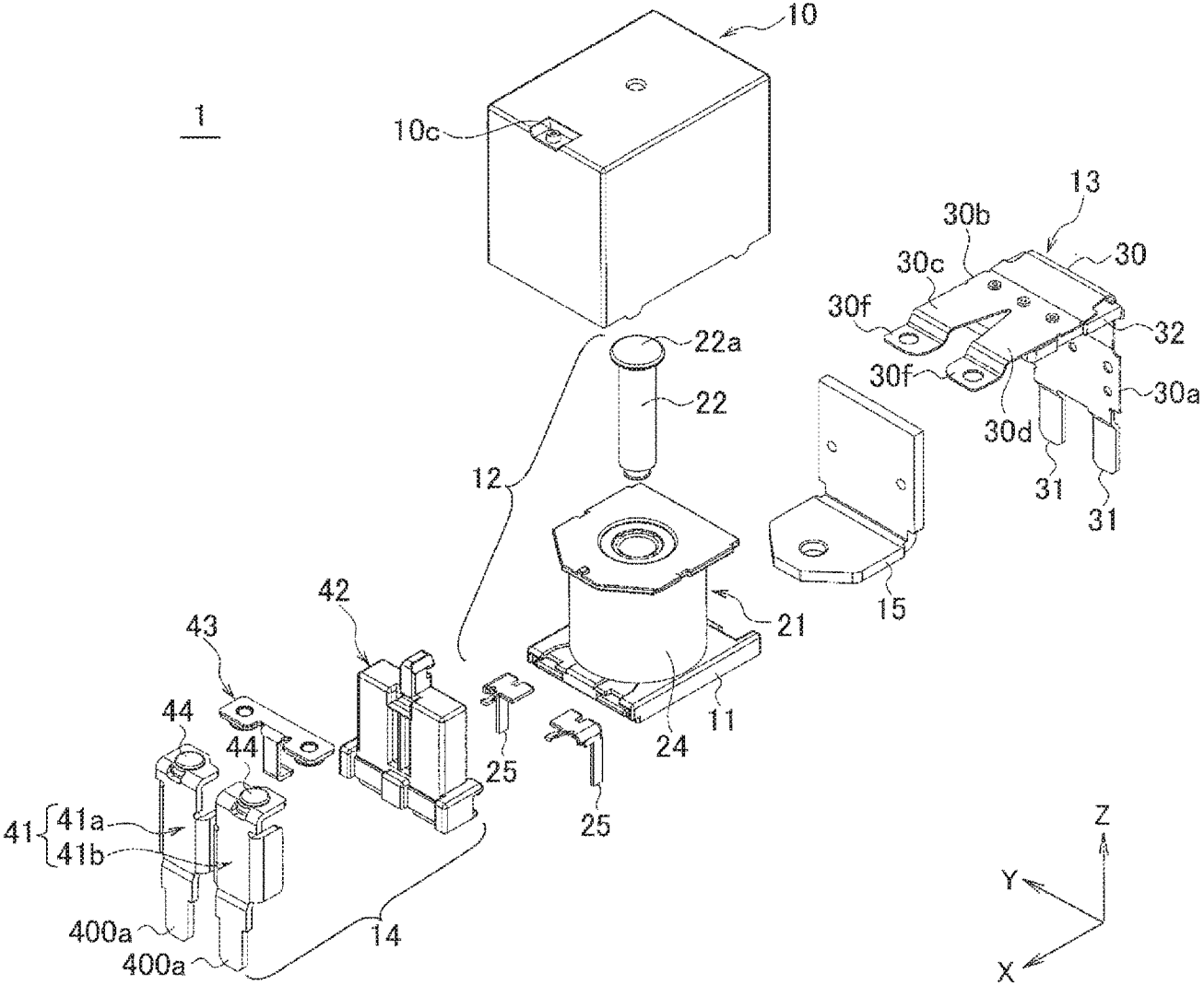
FIG. 4 is an exploded perspective view of the electromagnetic relay according to the embodiment.

To begin with, descriptions will be provided for an electromagnetic relay according to a first embodiment. FIG. 1 is a perspective view illustrating an external appearance of the electromagnetic relay 1 according to this embodiment. FIG. 2 is a perspective view illustrating an internal configuration of the electromagnetic relay 1, exclusive of a cover 10. FIG. 3 is a cross-sectional view of the electromagnetic relay 1 taken along the A-A line in FIG. 1. FIG. 4 is an exploded perspective view of the electromagnetic relay 1.

The electromagnetic relay 1 is an electronic part which is installed in various electronics, and which turns on or off an electric current. The electromagnetic relay 1 includes the cover 10, an electromagnetic device 12, a movable contact unit 13, a fixed contact unit 14 and a yoke 15.

The cover 10 is made of, for example, a resin. The cover 10 houses various components such as the electromagnetic device 12. The cover 10 is a box body shaped like a rectangular prism, and includes a ceiling wall 10*a* and side walls 10*b* surrounding the ceiling wall 10*a*. The ceiling wall 10*a* of the cover 10 is provided with a ventilation hole 10*c* through which air can flow between an inner space and an outer space of the cover 10.

The ventilation hole 10*c* inhibits an increase in pressure inside the cover 10 while, as discussed later, the inner space is sealed off using a sealing material, and discharges heat generated in the inner space by an energizing operation to the outside of the cover 10. Incidentally, descriptions will be later provided for where to place the ventilation hole 10*c*.

The electromagnetic device 12 displaces the movable spring 30*b* included in the movable contact unit 13 each time the electromagnetic device 12 is excited or de-excited based on energization from the outside depending on the necessity. The electromagnetic device 12 includes: an iron core 22 having an attraction piece 22*a* in its distal end; a coil bobbin 23 supporting the iron core 22; a coil 24 of wire wound around the coil bobbin 23; and two coil terminals 25. Each coil terminal 25 is a connecting terminal. One end of the coil terminal 25 is connected to the coil 24, and the other end of the coil terminal 25 projects to the outside. The coil bobbin 23 is made of a synthetic resin-made insulating material.

The base of the electromagnetic relay 1 is formed from: a support 42*b* of a fixed terminal retainer 42 which will be discussed later; and a flange 11 of the coil bobbin 23. When viewed from the Z direction, the base is rectangular. The base is attached to the cover 10 with the peripheral portion of the base in engagement with the inner peripheral portion of an opening portion 10*d* of the cover 10. In this state, as illustrated in FIG. 3, the coil 24 of the electromagnetic device 12, the movable contacts 33 of the movable contact unit 13, the fixed contacts 44 of the fixed contact unit 14, and the yoke 15 are housed in the inner space of the cover 10. Each connecting terminal projects from the inner space to the outside. The inner space of the cover 10 is sealed off by, although not illustrated, filling a sealing material made of a liquid curable resin, such as an epoxy seal, into a gap in the lower surface of the base. This makes it possible to make the inner space more dustproof, and to increase the strength of support for the each connecting terminal.

The movable contact unit 13 includes a main body 30, movable terminals 31, and an armature 32.

The main body 30 includes: a fixed portion 30*a* connected to the yoke 15; and a movable spring 30*b* continued to the fixed portion 30*a*, and being movable. The fixed portion 30*a* is a flat plate portion extending in the Z direction. The movable spring 30*b* is a flat plate portion extending to the plus side in the X direction. An X-direction plus-side distal end part of the movable spring 30*b* is divided into two portions. Of the two movable divided portions, one situated on the plus side in the Y direction is a first movable divided portion 30*c*, and the other situated on the minus side in the Y direction is a second movable divided portion 30*d*. The first and second movable divided portions 30*c*, 30*d*, respectively, have the movable contacts 33 on first surfaces 30*e* which correspond to Z-direction minus-side parts of the X-direction plus-side distal end areas of the first and second movable divided portions 30*c*, 30*d*. The two movable contacts 33 change their positions in the Z direction when the movable spring 30*b* swings on its opposite end which continues to the fixed portion 30*a*.

Each movable terminal 31 is a connecting terminal with its one end connected to the fixed portion 30*a* of the main body 30, and with its opposite end projecting to the outside. This embodiment has two movable terminals 31.

The armature 32 is a flat plate-shaped conductor set on the movable spring 30*b*. One surface of the armature 32 faces the surface of the attraction piece 22*a* of the iron core 22.

Each of the main body 30 and the movable terminals 31 can be formed by curving a conductive sheet metal material which is blanked in a predetermined shape. Incidentally, the main body 30 and the movable terminals 31 may be separately-formed components to be connected together when produced, or may be formed integrally from the beginning.

The fixed contact unit 14 includes fixed terminals 41, the fixed terminal retainer 42, and a backstop 43.

Each fixed terminal 41 is a connecting terminal which has a fixed contact 44 on its one end, and whose opposite end projects to the outside. The fixed terminal 41 can be formed by curving a conductive sheet metal material which is blanked in a predetermined shape. This embodiment has two fixed terminals 41.

Figure 5:
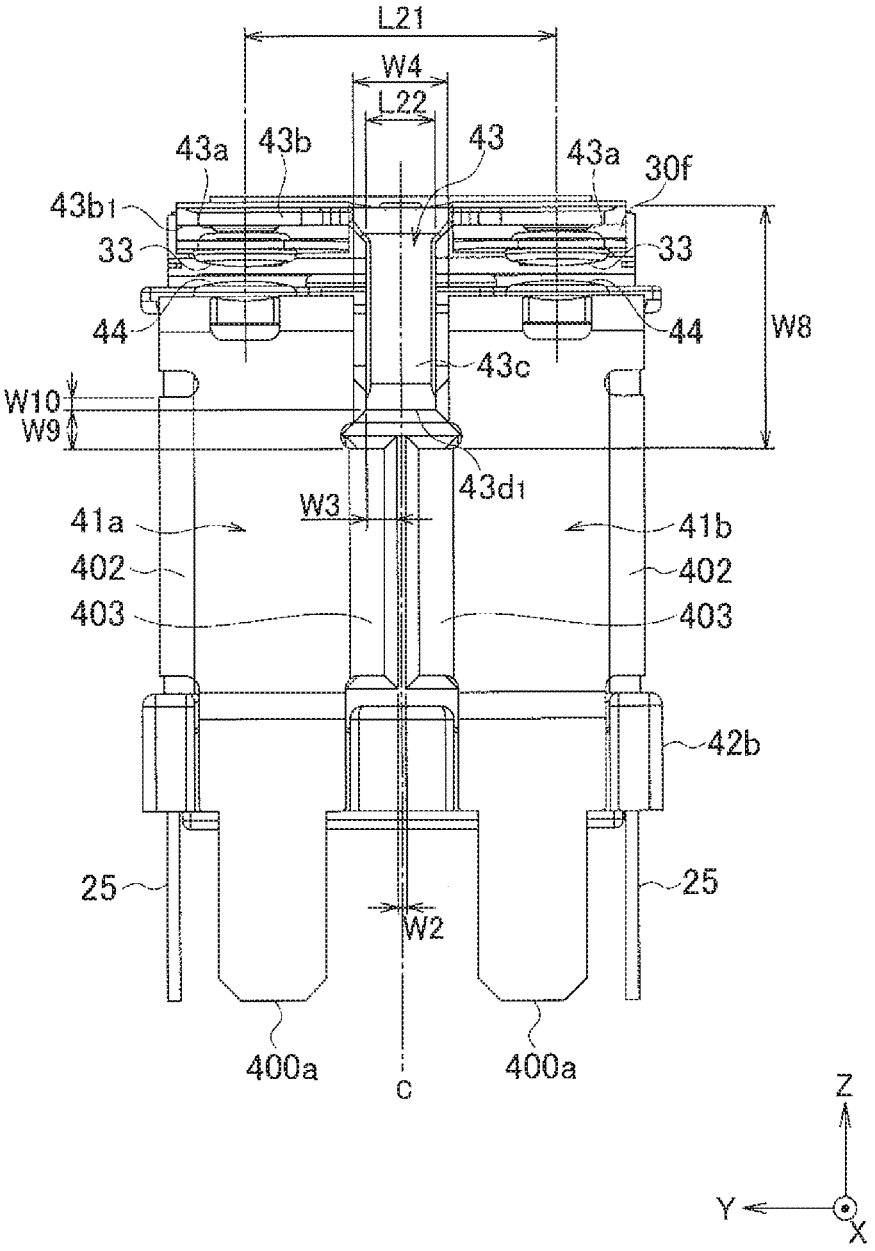
FIG. 5 is a side view illustrating the internal configuration of the electromagnetic relay according to the embodiment.

FIG. 5 is a side view of the internal configuration of the electromagnetic relay 1 from the plus side in the X direction. The two fixed terminals 41 have their respective shapes which are symmetrical with respect to a center line C in the Y direction. The two fixed terminals 41 are placed adjacent to each other with the center line C interposed in between. Of the two fixed terminals 41, hereinafter, one situated on the plus side in the Y direction is referred to as a first fixed terminal 41*a*, and the other situated on the minus side in the Y direction is referred to as a second fixed terminal 41*b*.

Figure 6:
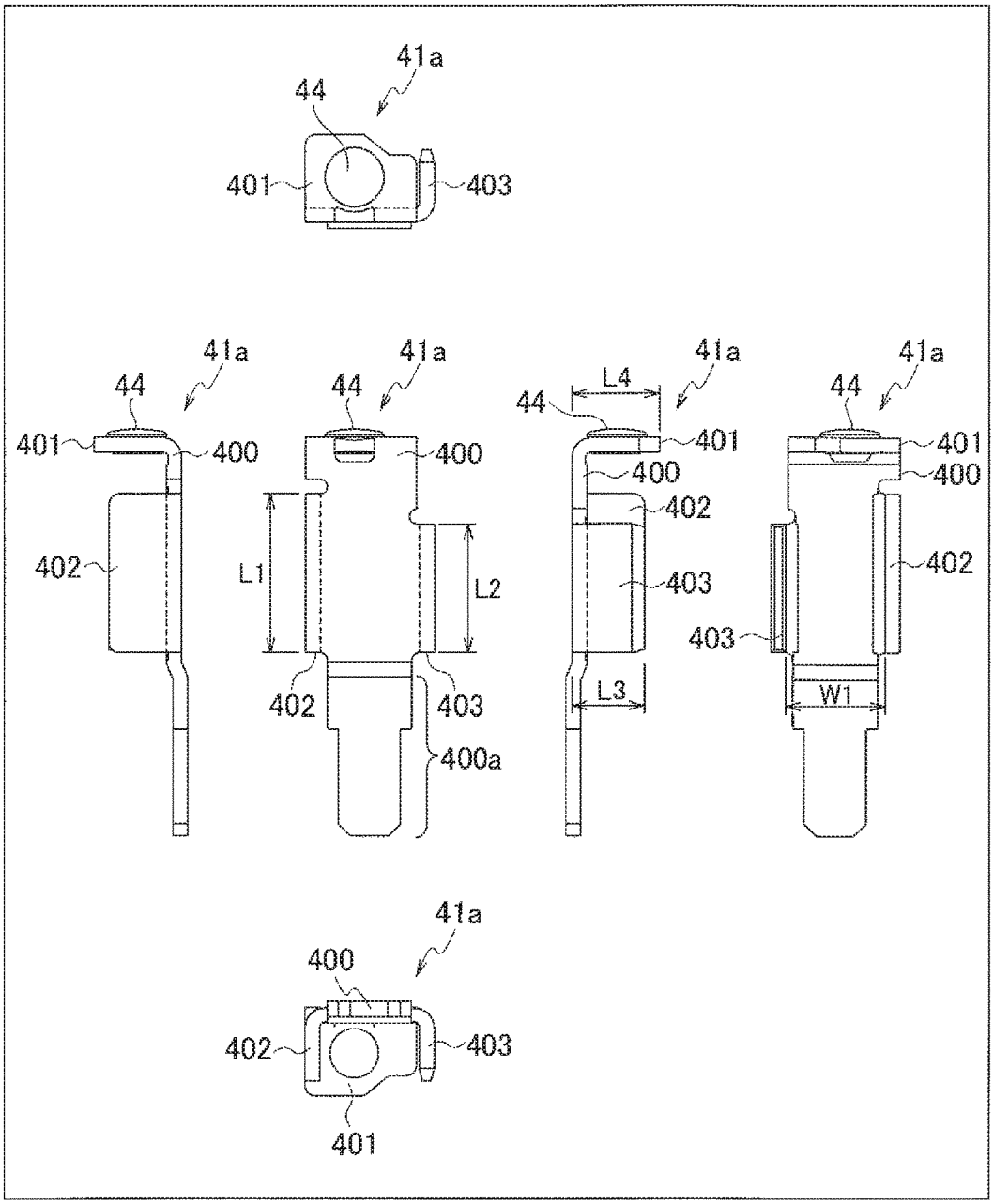
FIG. 6 is a view illustrating a shape of a fixed terminal in the embodiment.

FIG. 6 is a view illustrating the shape of the first fixed terminal 41*a*. FIG. 6 includes a top view, a side view from the plus side in the Y direction, a front view of the first fixed terminal 41*a* from the plus side in the X direction, a side view from the minus side in the Y direction, a back view and a bottom view. Incidentally, the directions indicated by the X, Y and Z axes in FIG. 6 are the same as those in the other drawings. The first fixed terminal 41*a* includes the following four flat plate portions.

A fixed terminal main body 400 is a flat plate portion whose main plane is a YZ plane facing in the X direction, and which extends in the Z direction. The fixed terminal main body 400 is a flat plate portion which is among the flat plate portions of the first fixed terminal 41*a*, and which includes a terminal portion 400*a* projecting to the outside. Incidentally, in the example illustrated in FIG. 6, the terminal portion 400*a* of the fixed terminal main body 400 is slightly offset in the X direction compared with the other portions of the fixed terminal main body 400 in light of the stability of the electromagnetic relay 1 after assembled or the like.

A fixed contact retainer 401 is a flat plate portion whose main plane is an XY plane, which continues to the Z-direction plus-side edge of the fixed terminal main body 400, and which curves to the minus side in the X direction, that is to say, a direction opposite to the direction in which the movable spring 30*b* extends. The fixed contact 44 is placed on the first surface corresponding to the Z-direction plus-side part of the fixed contact retainer 401. Thus, as illustrated in FIG. 5, the two fixed contacts 44 included in the fixed contact unit 14 and the two movable contacts 33 included in the movable contact unit 13 are arranged along the Z direction, respectively, facing each other in pairs.

A fixed terminal arm portion 402 is a flat plate portion whose main plane is an XZ plane, which continues to a Y-direction plus-side first edge of the fixed terminal main body 400, and which curves to the minus side in the X direction. In contrast to the fixed terminal main body 400, the fixed terminal arm portion 402 is a flat plate portion which is among the flat plate portions of the first fixed terminal 41*a*, but which does not include the terminal portion 400*a*.

A terminal arm portion 403 is a flat plate portion whose main plane is an XZ plane, which continues to a Y-direction minus-side second edge of the fixed terminal main body 400, and which curves to the minus side in the X direction.

Here, of the flat plate portions of the first fixed terminal 41*a*, for example, one facing in the second direction, or the X direction is defined as a first side terminal portion, and another one curving from the first edge of the first side terminal portion in a direction opposite to the second direction is defined as a second side terminal portion. When these definitions are applied to this embodiment, the fixed terminal main body 400 corresponds to the first side terminal portion, and the fixed terminal arm portion 402 corresponds to the second side terminal portion.

In addition, as illustrated in FIG. 6, a Z-direction length L1 of the fixed terminal arm portion 402 is greater than a Z-direction length L2 of the terminal arm portion 403. Meanwhile, both an X-direction length of the fixed terminal arm portion 402 and an X-direction length of the terminal arm portion 403 are L3. Furthermore, the length L3 is approximately equal to an X-direction length L4 of the fixed contact retainer 401.

Because of the existence of the fixed terminal arm portion 402 and the terminal arm portion 403, the first fixed terminal 41*a* has a space between the fixed terminal arm portion 402 and the terminal arm portion 403. A Y-direction width of this space is denoted by W1.

It should be noted that: as discussed above, the shape of the second fixed terminal 41*b* is just symmetrical to that of the first fixed terminal 41*a* with respect to the center line C in the Y direction illustrated in FIG. 5; and the two fixed terminals may be regarded as having the same shape. For this reason, detailed descriptions for the second fixed terminal 41*b* will be omitted.

Figure 7:
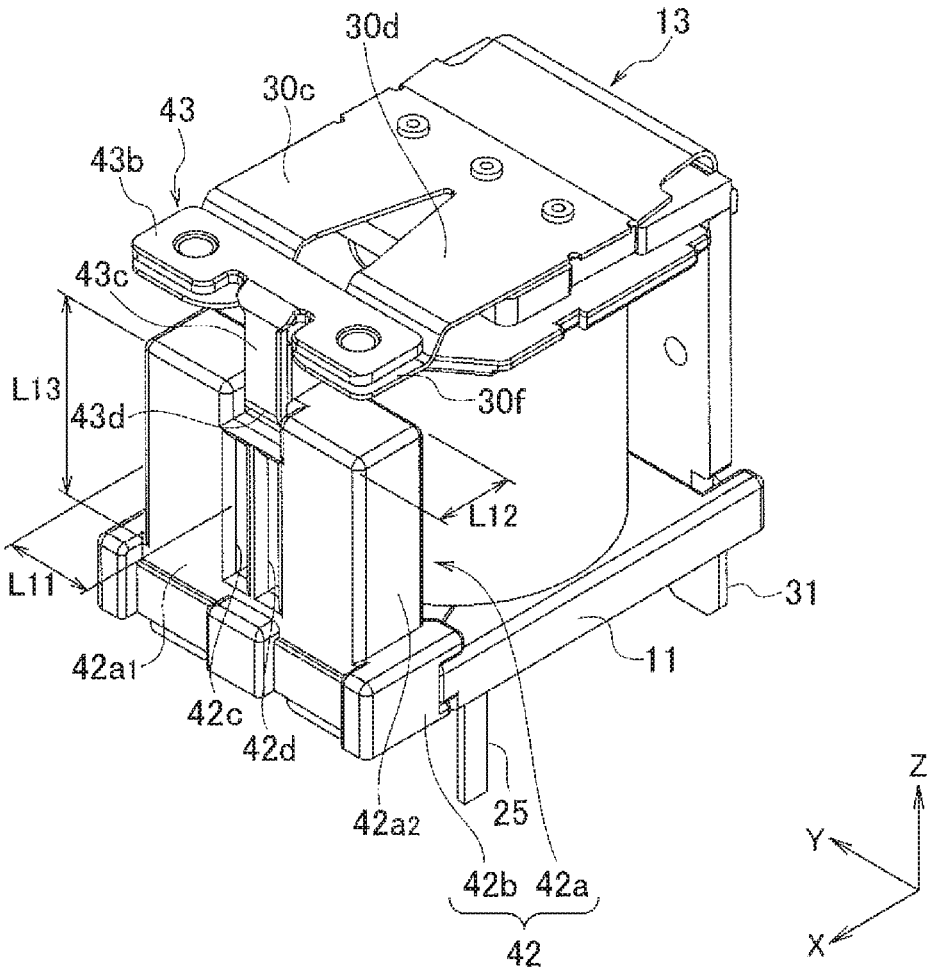
FIG. 7 is a view of the internal configuration illustrated in FIG. 2, exclusive of the fixed terminals.

FIG. 7 is a perspective view illustrating the internal configuration of the electromagnetic relay 1 illustrated in FIG. 2, from which the first fixed terminal 41*a* and the second fixed terminal 41*b* are excluded for the explanation sake.

The fixed terminal retainer 42 retains the first fixed terminal 41*a* and the second fixed terminal 41*b*. The fixed terminal retainer 42 is made of an insulating material. The fixed terminal retainer 42 includes: a fixed terminal fixation portion 42*a* in contact with the first fixed terminal 41*a* and the second fixed terminal 41*b*; and the support 42*b* which continues to the fixed terminal fixation portion 42*a*, and which is combined with the flange 11 of the coil bobbin 23.

The fixed terminal fixation portion 42*a* is a rectangular prism-shaped member which is installed upright from the support 42*b*, a part of the base, to the plus side in the Z direction.

The fixed terminal fixation portion 42*a* includes a first side portion 42$a_1$ which faces the first fixed terminal 41*a* or the second fixed terminal 41*b* in the X direction. The first side portion 42$a_1$ includes the following three hole portions formed therein.

Terminal hole portions 42*c*, 42*d*, respectively, house at least parts of the terminal arm portions 403. Of these terminal hole portions 42*c*, 42*d*, the terminal hole portion 42*c* houses the terminal arm portion 403 of the first fixed terminal 41*a* when the first fixed terminal 41*a* is combined with the fixed terminal fixation portion 42*a*. Similarly, the terminal hole portion 42*d* houses the terminal arm portion 403 of the second fixed terminal 41*b* when the second fixed terminal 41*b* is combined with the fixed terminal fixation portion 42*a*. In other words, for the purpose of realizing the above-discussed housing, the terminal hole portions 42*c*, 42*d* are arranged in a Y-direction center area of the fixed terminal fixation portion 42*a*. Here, the terminal hole portions 42*c*, 42*d* are not in contact with each other. Thus, after the first fixed terminal 41*a* and the second fixed terminal 41*b* are combined with the fixed terminal fixation portion 42*a*, too, the first fixed terminal 41*a* and the second fixed terminal 41*b* are separate away from each other with a width W2 in between, as illustrated in FIG. 5.

As illustrated in FIG. 3, a backstop hole portion 42*e* houses a backstop end portion 43*d* provided in a part of the later-discussed backstop 43, and thereby supports the backstop 43. The backstop hole portion 42*e* is located in the Y-direction center area of the fixed terminal fixation portion 42*a*, and to the plus side in the Z direction from the terminal hole portions 42*c*, 42*d*.

Moreover, the fixed terminal fixation portion 42*a* includes two second side surfaces 42$a_2$ which continue to the first side portion 42$a_1$, one of which faces to the plus side in the Y direction, and the other of which faces to the minus side in the Y direction. When the first fixed terminal 41*a* is combined with the fixed terminal fixation portion 42*a*, one second side surface 42$a_2$ comes into contact with an inner surface of the fixed terminal arm portion 402 of the first fixed terminal 41*a*, or faces the inner surface of the fixed terminal arm portion 402 of the first fixed terminal 41*a* with a space in between. Thereby, as illustrated in FIG. 2, the second side surface 42$a_2$ is covered with the fixed terminal arm portion 402 of the first fixed terminal 41*a*. Similarly, when the second fixed terminal 41*b* is combined with the fixed terminal fixation portion 42*a*, the other second side surface 42$a_2$ comes into contact with an inner surface of the fixed terminal arm portion 402 of the second fixed terminal 41*b*, or faces the inner surface of the fixed terminal arm portion 402 of the second fixed terminal 41*b* with a space in between. Thereby, as illustrated in FIG. 2, the second side surface 42$a_2$ is covered with the fixed terminal arm portion 402 of the second fixed terminal 41*b*.

In this respect, for the purpose of realizing the above-discussed housing and covering, a length L11 between a Y-direction plus-side inner surface of the terminal hole portion 42*c* and the Y-direction plus side-situated second side surface 42$a_2$ is approximately equal to a width W1 of the first fixed terminal 41*a*. Similarly, the length L11 between a Y-direction minus-side inner surface of the terminal hole portion 42*d* and the Y direction minus side-situated second side surface 42$a_2$ is approximately equal to the width W1 of the second fixed terminal 41*b*.

In addition, an X-direction length L12 of the second side surface 42$a_2$ is equal to or slightly longer than the X-direction length L3 of the fixed terminal arm portion 402.

Furthermore, a Z-direction length L13 of the fixed terminal fixation portion 42*a* is set at a length which, after all the internal components are assembled together as illustrated in FIG. 5, does not allow the fixed contacts 44 and the movable contacts 33 to be too away from each other when the movable contacts 33 are detached from the fixed contacts 44, and which causes no abnormal current flow while the movable contacts 33 are away from the fixed contacts 44.

The backstop 43 is a restraint member which inhibits displacements of the first and second movable divided portions 30*c*, 30*d* with the movable contacts 33 set thereon. The backstop 43 can be formed by curving a conductive sheet metal member which is blanked in a predetermined shape.

The backstop 43 includes restraint portions 43*a*, an arm portion 43*b*, a leg portion 43*c* and a backstop end portion 43*d*.

As illustrated in FIG. 5, so as to agree with the locations of the movable contacts 33, the restraint portions 43*a* face second surfaces 30*f* corresponding to Z-direction plus-side parts of X-direction plus-side distal areas of the first and second movable divided portions 30*c*, 30*d*. To put it specifically, this embodiment has two restraint portions 43*a*. Incidentally, the second surfaces 30*f* are located on the opposite sides of the first and second movable divided portions 30*c*, 30*d* from the first surfaces 30*e*. While the movable contacts 33 are away from the fixed contacts 44, the restraint portions 43*a* are contactable to parts of the second surfaces 30*f* which are on the opposite sides of the first and second movable divided portions 30*c*, 30*d* from the contact abutment-side first surfaces 30*e*.

The arm portion 43*b* is a flat plate portion extending in the Y direction. The arm portion 43*b* includes a first surface $43b_1$ which faces the movable contacts 33. The two restraint portions 43*a* are placed on the first surface $43b_1$.

The leg portion 43*c* is a flat plate portion which continues from the arm portion 43*b*, and which, as illustrated in FIG. 5, curves from the center of a Y-direction length L21 between the two restraint portions 43*a* to the contact-abutment side, that is to say, to the minus side in the Z direction.

The backstop end portion 43*d* is a flat plate portion which, as illustrated in FIG. 3, curves from an end of the leg portion 43*c* in the direction opposite to the X direction, that is to say, to the minus side in the X direction. The backstop end portion 43*d* is housed in the backstop hole portion 42*e* in the fixed terminal fixation portion 42*a*, as discussed above.

Here, a Y-direction length L22 of the leg portion 43*c* is shorter than the length L21 between the two restraint portions 43*a*, as illustrated in FIG. 5. In addition, while the first and second fixed terminals 41*a*, 41*b* are retained by the fixed terminal retainer 42, at least part of the leg portion 43*c* overlaps the terminal arm portions 403 of the respective first and second fixed terminals 41*a*, 41*b* when viewed from an axis extending in the Y direction which intersects the Z direction and the X direction. In FIG. 5, a width of the Y-direction overlap between the leg portion 43*c* and the terminal arm portion 403 of the first fixed terminal 41*a* is denoted by W3. Furthermore, while the first and second fixed terminals 41*a*, 41*b* are retained, the Y-direction length L22 of the leg portion 43*c* (the width of the leg portion 43*c*) is less than a width W4 between the first and second fixed terminals 41*a*, 41*b* on the plus side in the Z direction of the terminal arm portions 403.

Besides, as illustrated in FIG. 3, the leg portion 43*c* curves in the X direction from a position in the restraint portions 43*a*-placing area which is set back inward from the X-direction plus-side end portion of the arm portion 43*b*, that is to say, a position which is offset to the minus side in the X direction by a width W5. In addition, a backstop hole portion 42*e*-forming surface of the fixed terminal fixation portion 42*a* is offset to the minus side in the X direction by a width W6 from a terminal hole portions 42*c*, 42*d*-forming surface of the fixed terminal fixation portion 42*a*. Thus, while the first and second fixed terminals 41*a*, 41*b* are retained, a space with a width W7 occurs in the X direction between the surface of the fixed terminal main body 400 and the surface of the leg portion 43*c* of the backstop 43. In other words, a space S with a Y-direction dimension of W4, and with a Z-direction dimension of W8 is formed between the leg portion 43*c* and the side wall 10*b* of the cover 10 adjacent to the leg portion 43*c*.

Moreover, as illustrated in FIG. 5, while the first and second fixed terminals 41*a*, 41*b* are retained, the backstop end portion 43*d* and the terminal arm portion 403 are away from each other in the Z direction with a width W9 in between. Meanwhile, a lower surface $43d_1$ of the backstop end portion 43*d* is lower in the Z direction by a width W10 than a Z-direction plus-side distal end of the fixed terminal arm portion 402. In other words, the backstop end portion 43*d* is placed in Z-direction between fixed contact 44-side end portions of the fixed terminal arm portions 402 and fixed contact 44-side end portions of the terminal arm portions 403.

In addition, the yoke 15 is a plate member which is made, for example, of a magnetic steel, and which is curved so that its cross section is formed in the shape of the letter L. As described above, one flat plate portion of the yoke 15 retains the fixed portion 30*a* included in the main body 30 of the movable contact unit 13. The other flat plate portion of the yoke 15 is connected to the iron core 22 included in the electromagnetic device 12. Thus, when the electromagnetic device 12 is driven, a magnetic circuit is formed by the iron core 22, the armature 32 and the yoke 15.

Next, descriptions will be provided for how the contacts in the electromagnetic relay 1 work. The movable contacts 33 and the fixed contacts 44 are arranged facing each other in the Z direction, respectively. When the coil 24 of the electromagnetic device 12 is de-energized, the sets of movable and fixed contacts 33, 44 are opened. On the other hand, when the coil 24 is energized, the movable contacts 33 come closer to and into contact with the fixed contacts 44. In this respect, the de-energization of the coil 24 means de-excitation of the electromagnetic device 12. When the electromagnetic device 12 is de-excited, a biasing force of the movable spring 30*b* to the minus side in the Z direction holds the armature 32 away from the attraction piece 22*a*. Meanwhile, the energization of the coil 24 means excitation of the electromagnetic device 12. When the electromagnetic device 12 is excited, a magnetic force of the attraction piece 22*a* is greater than the biasing force of the movable spring 30*b*, and the armature 32 comes into contact with the attraction piece 22*a*. The above swing movement of the fixed contacts 44 makes the movable contacts 33 come into or out of contact with the fixed contacts 44, and thus the sets of contacts are opened or closed. In other words, the electromagnetic relay 1 works such that when the electromagnetic device 12 is switched to be energized or de-energized, the movable contacts 33 come into contact or out of contact with the fixed contacts 44. Incidentally, in this embodiment, the fixed terminal 41 includes two fixed terminals: the first fixed terminal 41*a* and the second fixed terminal 41*b* which are independent from each other. Accordingly, when the sets of fixed and movable contacts 44, 33 are opened, the first and second fixed terminal 41*a*, 41*b* are not electrically connected to each other.

Next, descriptions will be provided for how the electromagnetic relay 1 works, and what effects the electromagnetic relay 1 brings about.

In this embodiment, each fixed terminal 41 includes not only the fixed terminal main body 400 including the terminal portion 400*a* and the fixed contact retainer 401 including the fixed contact 44, but also the fixed terminal arm portion 402 and the terminal arm portion 403. The fixed terminal main body 400 and the fixed contact retainer 401 extend in the first direction as the Z direction, for example. The fixed terminal arm portion 402 curves from the first edge of the fixed terminal main body 400 in the direction opposite to the second direction as the X direction, for example, and covers the side surface of the fixed terminal retainer 42. The terminal arm portion 403 curves from the second edge of the fixed terminal main body 400 in the direction opposite to the second direction, and is housed in one of the terminal hole portions 42*c*, 42*d* formed in the fixed terminal retainer 42. This configuration makes it possible to further increase the surface area of the fixed terminal 41 by those of the fixed terminal arm portion 402 and the terminal arm portion 403, as well as to accordingly inhibit an increase in the size of the fixed terminal 41, and an increase in the external dimensions of the electromagnetic relay 1. Thus, a higher current carrying capacity of the electromagnetic relay 1 and a decrease in the size thereof can be achieved at the same time.

In addition, like the fixed terminal arm portion 402, the terminal arm portion 403 has a long plate shape with a wide surface area. The terminal arm portion 403 is housed in one of the terminal hole portions 42*c*, 42*d* formed in the fixed terminal retainer 42. This makes it possible to arrange the entirety of the fixed terminal main body 400 to face the cover 10, and accordingly to radiate heat efficiently. Furthermore, the terminal arm portion 403 makes it possible for the fixed terminal retainer 42 to retain the fixed terminal 41 more stably and firmly. Particularly, because the surface area of the fixed terminal arm portion 402 facing the cover 10 can be large, heat can be efficiently radiated from the fixed terminal 41, as well as a higher current carrying capacity and a decrease in the size can be achieved at the same time. Moreover, because the surface area of the fixed terminal arm portion 402 is wide enough to cover the second side surface $42a_2$ of the fixed terminal retainer 42, heat can be efficiently radiated from the fixed terminal 41, and the insulation from the electromagnetic device 12 can be secured. Here, that the surface area of the fixed terminal arm portion 402 is wide enough to cover the second side surface $42a_2$ of the fixed terminal retainer 42 means that, for example, the second direction length L3 of the fixed terminal arm portion 402 is set approximately equal to the second direction length L12 of the second side surface $42a_2$.

Besides, in the inside of the electromagnetic relay 1, the fixed terminal arm portion 402 is arranged to cover the second side surface $42a_2$. Meanwhile, since the terminal arm portion 403 is housed in one of the terminal hole portions 42*c*, 42*d* formed in the fixed terminal retainer 42, the terminal arm portion 403, after assembled, is contained in the fixed terminal retainer 42. In other words, although the surface area of the fixed terminal 41 increases by those of the fixed terminal arm portion 402 and the terminal arm portion 403, the fixed terminal 41 is compactly contained in the internal configuration of the electromagnetic relay 1. This makes it possible to inhibit an increase in the size of the electromagnetic relay 1.

Furthermore, as for the backstop 43, as indicated with the width W7 in FIG. 3, the leg portion 43*c* of the backstop 43 is away from the fixed terminal main body 400 as the first side terminal portion of this embodiment in the direction opposite to the second direction. What is more, on a projection plane with the perpendicular extending in the second direction, the leg portion 43*c* of the backstop 43 is provided between the two movable contacts 33 when viewed from the first direction. This is advantageous to increase insulation between the fixed terminal 41 and the backstop 43.

Moreover, on the projection plane with the perpendicular extending in the second direction, the backstop end portion 43*d* and the backstop hole portion 42*e* are provided between the two movable contacts 33 when viewed from the first direction. This is advantageous to secure the insulation between the fixed terminal 41 and the backstop 43, as well as to reduce the size. Furthermore, in connection with this, it is desirable that the opening of the backstop hole portion 42*e* be placed off the openings of the terminal hole portions 42*c* and 42*d* in which to house the terminal arm portions 403, in the first direction. In addition, at least part of the leg portion 43*c* of the backstop 43 may overlap the terminal arm portion 403 when viewed from an axis extending in the third direction which intersects the first and second directions.

Here, both the terminal arm portion 403 included in the fixed terminal 41 and the backstop end portion 43*d* included in the backstop 43 curve to the minus side in the X direction, that is to say, in the direction opposite to the second direction. Thus, from the plus side in the X direction, the terminal arm portion 403 and the backstop end portion 43*d* are housed, respectively, into the terminal hole portion 42*c* or 42*d* and the backstop hole portion 42*e* which are formed in the fixed terminal retainer 42. Accordingly, when it comes to a process of assembling the electromagnetic relay 1, all the components illustrated in FIG. 4, except the cover 10, can be sequentially assembled into the electromagnetic relay 1 in one direction, that is to say, in the X direction in this case. For example, the assembling sequence starting with the movable contact unit 13 may be such that the movable contact unit 13 is combined with the yoke 15, subsequently with the electromagnetic device 12, thereafter with the fixed terminal retainer 42, and finally followed by engaging the terminal arm portion 403 and the backstop end portion 43*d*. Like this, the shapes of the respective terminal arm portion 403 and the backstop end portion 43*d* are advantageous to make the process of assembling the electromagnetic relay 1 simpler and easier. Thus, the fixed terminal retainer 42 retains the electromagnetic device 12 and the coil terminals 25.

In addition, as indicated with the width W3 in FIGS. 3 and 5, on the projection plane with the perpendicular extending in the second direction, the backstop hole portion 42*e* may overlap the fixed terminal main body 400 as the first side terminal portion of this embodiment when viewed from the first direction. This makes it possible to make particularly a third direction dimension of the electromagnetic relay 1 smaller, and is advantageous to make the electromagnetic relay 1 compact in size.

In addition, as illustrated in FIG. 6, the Z-direction length L1 of the fixed terminal arm portion 402 may be greater than the Z-direction length L2 of the terminal arm portion 403. In other words, the fixed terminal arm portion 402 is longer in the first direction than the terminal arm portion 403. Thus, the length L1 of the fixed terminal arm portion 402 can be set as long as possible, so that the radiation of heat from the fixed terminal 41 can be accordingly facilitated. On the other hand, since the length L2 of the terminal arm portion 403 is set less than the length L1 of the fixed terminal arm portion 402, the position in which to place the leg portion 43*c* of the backstop 43 can be allocated in a way to make the internal configuration of the electromagnetic relay 1 compact in size. In this respect, it is particularly desirable that, as indicated with the width W10 in FIG. 5, the backstop end portion 43*d* be arranged between the fixed contact 44-side end portions of the fixed terminal arm portion 402 and the fixed contact 44-side end portion of the terminal arm portion 403, when viewed from the Z direction.

The foregoing descriptions have shown an example of the configuration in which the electromagnetic relay 1 includes two fixed terminals 41, that is to say, the first fixed terminal 41*a* and the second fixed terminal 41*b*. In the present disclosure, however, the electromagnetic relay 1 may include one fixed terminal 41. The operation and effects of this case are the same as those obtained from the electromagnetic relay 1 which includes the two fixed terminals 41.

Meanwhile, in the case where the electromagnetic relay 1 includes the two fixed terminals 41, that is to say, the first fixed terminal 41*a* and the second fixed terminal 41*b*, the movable spring 30*b* may include the first and second movable divided portions 30*c*, 30*d* on which the respective movable contacts 33 are placed. In this case, it is desirable that the leg portion 43*c* of the backstop 43 curve from the center between the two restraint portions 43*a* provided to the arm portion 43*b*, and be arranged between the first fixed terminal 41*a* and the second fixed terminal 41*b*. Thus, as illustrated in FIG. 5, one part of the single leg portion 43*c* overlaps the terminal arm portion 403 of the first fixed terminal 41*a*, and an opposite part of the same leg portion 43*c* overlaps the terminal arm portion 403 of the second fixed terminal 41*b*, when viewed from the Y direction. This is advantageous to make particularly the Y-direction dimension of the electromagnetic relay 1 smaller in the case where the electromagnetic relay 1 includes the first and second fixed terminals 41*a*, 41*b*.

Furthermore, in the case where the electromagnetic relay 1 includes the first and second fixed terminals 41*a*, 41*b*, the leg portion 43*c* of the backstop 43 may be arranged between the first and second movable divided portions 30*c*, 30*d* when viewed from the first direction, in addition to the above-discussed configuration. This is advantageous to make particularly the X- and Z-direction dimensions of the electromagnetic relay 1 smaller.

Furthermore, as for the cover 10, as illustrated in FIGS. 1 and 3, the ventilation hole 10*c* may be provided between the leg portion 43*c* of the backstop 43 and the side wall 10*b* of the cover 10 adjacent to the leg portion 43*c*. In other words, when viewed from the first direction, the ventilation hole 10*c* may be provided between the leg portion 43*c* of the backstop 43 and the side wall 10*b* of the cover 10 adjacent to the leg portion 43*c*. First, when the cover 10 is provided with the ventilation hole 10*c*, its ventilation hole 10*c*-forming area projects to the inside of the cover 10. With this taken into consideration, the ventilation hole 10*c* is provided at a position in the cover 10 which corresponds to the space S formed between the leg portion 43*c* and the side wall 10*b*, as illustrated in FIG. 3. Thus, the space S accommodates the projecting portion of the ventilation hole 10*c* into the inside of the cover. For this reason, it is possible to inhibit an .increase in the size of the electromagnetic relay 1. Second, since the space S is adjacent to both of the first and second fixed terminals 41*a*, 41*b*, heat from the first and second fixed terminals 41*a*, 41*b* can be easily guided to the space S. For this reason, the arrangement of the ventilation hole 10*c* to face the space S makes it possible to efficiently discharge heat produced in the inside of the electromagnetic relay 1 to the outside.

As discussed above, this embodiment can provide the electromagnetic relay which is advantageous to achieve a higher current carrying capacity and a reduction in the size at the same time.

Second Embodiment

Next, descriptions will be provided for an electromagnetic relay according to a second embodiment. In the first embodiment, as for the backstop 43, one backstop end portion 43*d* and one corresponding backstop hole portion 42*e* are provided to fit the shape of the leg portion 43*c*. In other words, on the projection plane with the perpendicular extending in the X direction, the backstop hole portion 42*e* is arranged between the terminal hole portions 42*c*, 42*d* with which the terminal arm portions 403 of the respective first and second fixed terminals 41*a*, 41*b* come into engagement, when viewed from the Z direction. However, the present disclosure is not limited to this. Multiple backstop end portions and multiple corresponding backstop hole portions may be provided.

Figure 8:
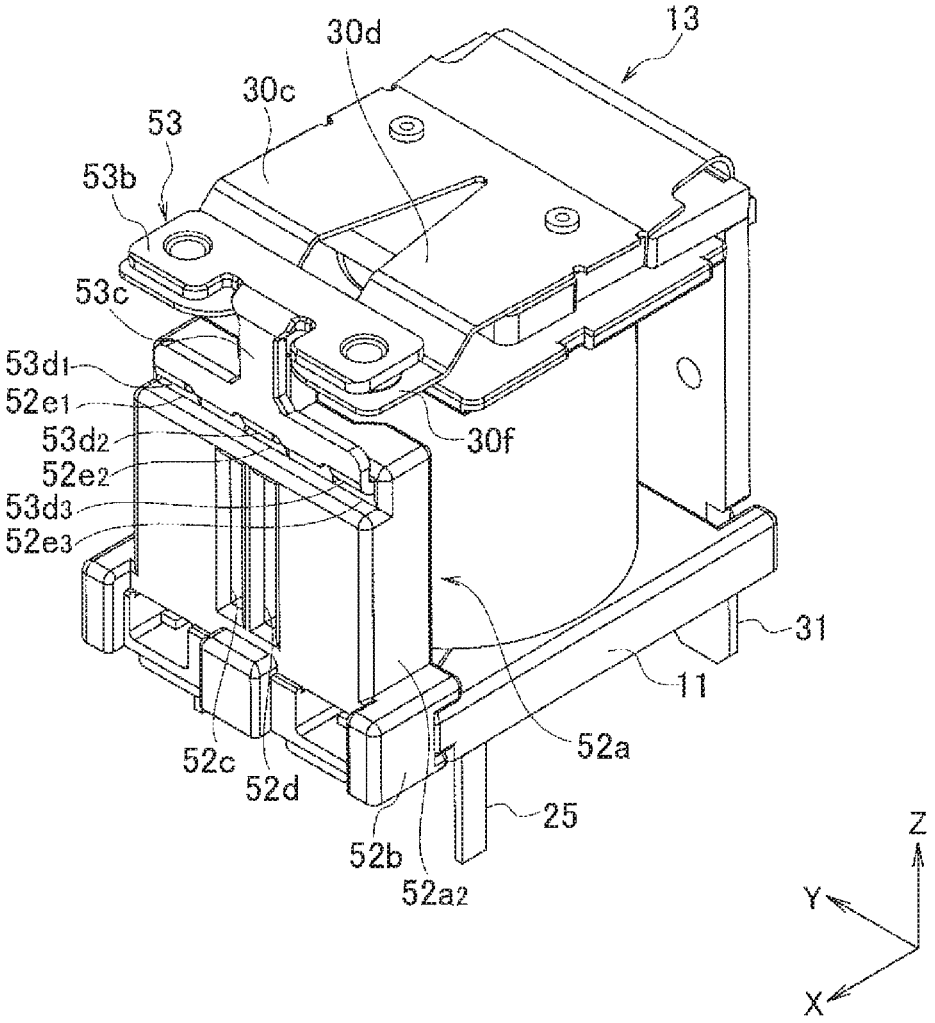
FIG. 8 is a view illustrating a shape of a backstop in an embodiment.

FIG. 8 is a perspective view illustrating a shape of a backstop 53 of the second embodiment. Incidentally, FIG. 8 corresponds to FIG. 7 which draws the backstop 43 of the first embodiment. Particularly, the backstop 53 illustrated in FIG. 8 corresponds to the backstop 43 illustrated in FIG. 7. In addition, a fixed terminal retainer 52 illustrated in FIG. 8 corresponds to the fixed terminal retainer 42 illustrated in FIG. 7.

The shape of an arm portion 53*b* included in the backstop 53 is the same as that of the arm portion 43*b* illustrated in FIG. 7. Meanwhile, the backstop 53 includes: one leg portion 53*c*; and three backstop end portions $\mathbf{53}d_1$, $\mathbf{53}d_2$, $\mathbf{53}d_3$ arranged along a line in which two restraint portions placed on the arm portion 53*b* stands side by side in the Y direction. The shapes of a fixed terminal fixation portion 52*b* and terminal hole portions 52*c*, 52*d* in the fixed terminal retainer 52 are substantially the same as those of the support 42*b* and the terminal hole portions 42*c*, 42*d* illustrated in FIG. 7, respectively. Meanwhile, a fixed terminal fixation portion 52*a* in the fixed terminal retainer 52 includes three backstop hole portions $\mathbf{52}e_1$, $\mathbf{52}e_2$, $\mathbf{52}e_3$ formed therein to come into engagement with the three backstop end portions $\mathbf{53}d_1$, $\mathbf{53}d_2$, $\mathbf{53}d_3$, respectively.

Here, it is desirable that, as illustrated in FIG. 8, a pair consisting of the backstop end portion $\mathbf{53}d_2$ and the backstop hole portion $\mathbf{52}e_2$ be aligned with the leg portion 53*c* in the Y direction. Furthermore, it is desirable that a pair consisting of the backstop end portion $\mathbf{53}d_1$ and the backstop hole portion $\mathbf{52}e_1$ and a pair consisting of the backstop end portion $\mathbf{53}d_3$ and the backstop hole portion $\mathbf{52}e_3$ be placed symmetrically to each other with respect to the position of the leg portion 53*c* in the Y direction. Thus, while the backstop 53 is retained by the fixed terminal fixation portion 52*a*, stability of the backstop 53 to restrain the displacement of the movable spring 30*b* is greater than when the backstop 43 illustrated in FIG. 7 is used instead of the backstop 53. Accordingly, for example, even when the electromagnetic relay 1 receives an impact from the outside, the backstop 53 can inhibit the occurrence of a trouble such as a tilt of the arm portion 53*b* relative to the leg portion 53*c*.

In addition, even in the case where the backstop 53 is employed, arrangement of the three backstop hole portions $\mathbf{52}e_1$, $\mathbf{52}e_2$, $\mathbf{52}e_3$ relative to the fixed terminal fixation portion 52*a* particularly in the X direction and in the Z direction is the same as the arrangement of the backstop hole portion 42*e* in the case where the backstop 43 is employed.

It should be noted that in the case where, as discussed above, there are multiple backstop hole portions 52*e*, at least one of these backstop hole portions 52*e* may overlap the fixed terminal main body 400 as the first side terminal portion of this embodiment on the projection plane with the perpendicular extending in the second direction, when viewed from the first direction. For example, a configuration provided with no backstop end portion $\mathbf{53}d_2$ of the three backstop end portions $\mathbf{53}d_1$, $\mathbf{53}d_2$, $\mathbf{53}d_3$ may be employed. To put it specifically, the configuration may be provided with no backstop end portion $\mathbf{53}d_2$, and use two backstop hole portions $\mathbf{52}e_1$, $\mathbf{52}e_3$ which are respectively brought into engagement with the two symmetrically arranged backstop end portions $\mathbf{53}d_1$, $\mathbf{53}d_3$.

Third Embodiment

Next, descriptions will be provided for an electromagnetic relay according to a third embodiment. In the first embodiment, as for each fixed terminal 41, the fixed terminal main body 400 including the .terminal portion 400*a* is defined as the first side terminal portion facing in the second direction, and the fixed terminal arm portion 402 is defined as the second side terminal portion. In other words, in the first embodiment, the terminal portion 400*a* of the fixed terminal 41 is formed in a way that its main plane is the projection plane with the perpendicular extending in the X direction. The present disclosure, however, is not limited to this. The fixed terminal main body including the terminal portion may be defined as the second side terminal portion, while the fixed terminal arm portion may be defined as the first side terminal portion facing in the second direction.

Figure 9:
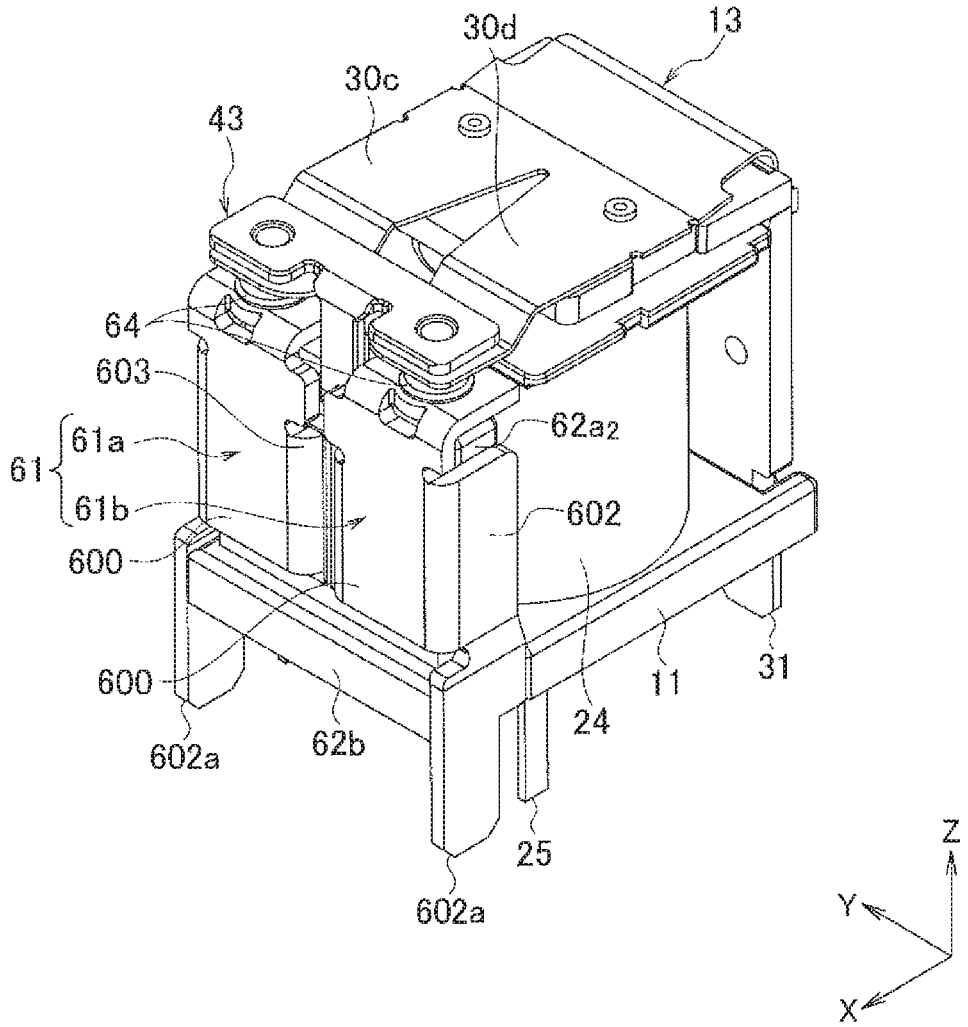
FIG. 9 is a view illustrating an internal configuration of an electromagnetic relay according to an embodiment.

FIG. 9 is a perspective view illustrating an internal configuration of the electromagnetic relay according to the third embodiment. Incidentally, FIG. 9 corresponds to FIG. 2 which illustrates the internal configuration of the electromagnetic relay 1 according to the first embodiment. In FIG. 9, the same components as those in the electromagnetic relay 1 according to the first embodiment are denoted by the same reference signs. Descriptions for such components will be omitted. To put it specifically, the shapes of fixed terminals 61 and a fixed terminal retainer 62 in the electromagnetic relay according to the third embodiment are different from those of the fixed terminals 41 and the fixed terminal retainer 42 in the electromagnetic relay 1 according to the first embodiment.

Figure 10:
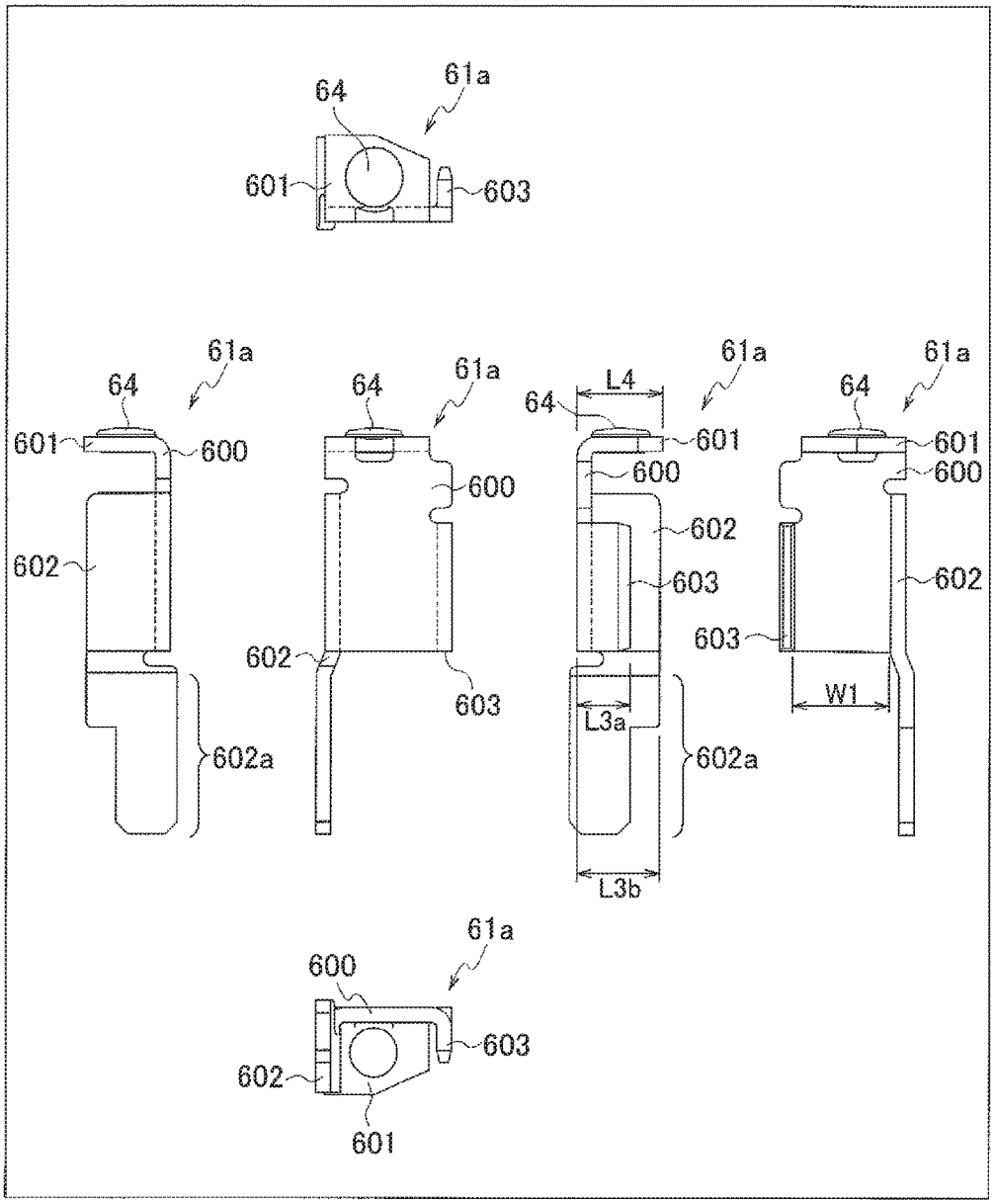
FIG. 10 is a view illustrating a shape of a fixed terminal in the embodiment.

FIG. 10 is a view illustrating a shape of a first fixed terminal 61*a*. Incidentally, the drawings in FIG. 10 correspond to the drawings in FIG. 6 which illustrates the shape of the first fixed terminal 41*a* according to the first embodiment. The first fixed terminal 61*a* includes the following four flat plate portions.

A fixed terminal main body 602 is a second side terminal portion in this embodiment. The fixed terminal main body 602 is a flat plate portion whose main plane is the XZ plane, which continues to a Y-direction plus-side first edge of a fixed terminal arm portion 600, and which curves to the minus side in the X direction. In addition, in this embodiment, the fixed terminal main body 602 includes a terminal portion 602*a* projecting to the outside.

The fixed terminal arm portion 600 is the first side terminal portion of this embodiment. The fixed terminal arm portion 600 is a flat plate portion whose main plane is the YZ plane facing in the X direction, and which extends in the Z direction. In addition, in this embodiment, the fixed terminal arm portion 600 includes no terminal portion which projects to the outside.

A fixed contact retainer 601 is a flat plate portion whose main plane is the XY plane, which continues to a Z-direction plus-side edge of the fixed terminal arm portion 600, and which curves to the minus side in the X direction. Like the fixed contacts 44 in the first embodiment, each fixed contact 64 is placed on a first surface which corresponds to a Z-direction plus-side part of the fixed contact retainer 601.

A terminal arm portion 603 is a flat plate portion whose main plane is the XZ plane, which continued to a Y-direction minus-side second edge of the fixed terminal arm portion 600, and which curves to the minus side in the X direction.

It should be noted that the dimensions of the flat plate portions included in the first fixed terminal 61*a* are equal to those of the flat plate portions included in the first fixed terminal 41*a* in the first embodiment. For example, as illustrated in FIG. 10, a Y-direction width of a space between the fixed terminal main body 602 and the terminal arm portion 603 is equal to W1 illustrated in FIG. 6. On the other hand, an X-direction length L3*a* of the terminal arm portion 603 may be shorter than an X-direction length L3*b* of the fixed terminal main body 602, which is approximately equal to an X-direction length L4 of the fixed contact retainer 601. In addition, the shape of a second fixed terminal 61*b* is only symmetrical to that of the first fixed terminal 61*a*, like in the first embodiment.

Figure 11:
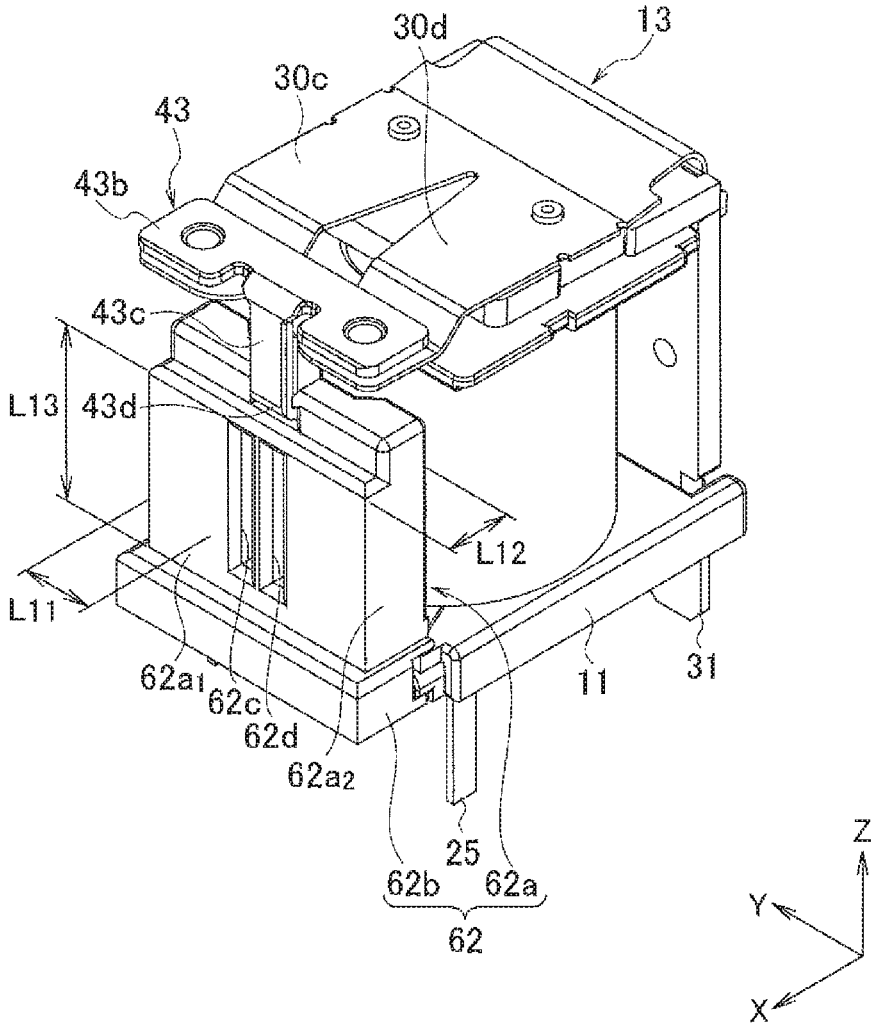
FIG. 11 is a view of the internal configuration illustrated in FIG. 9, exclusive of the fixed terminals.

FIG. 11 is a perspective view illustrating the internal configuration of the electromagnetic relay illustrated in FIG. 9, from which the first and second fixed terminals 61*a*, 61*b* are excluded for the explanation sake.

The basic shape of the fixed terminal retainer 62, inclusive of the dimensions of its various portions, is the same as that of the fixed terminal retainer 42 in the first embodiment. In this embodiment, too, a first side portion $\mathbf{62}a_1$ includes terminal hole portions 62*c*, 62*d* formed therein to house at least parts of the terminal arm portions 603, respectively. Positions at which to place the terminal hole portions 62*c*, 62*d* are the same as the positions at which to place the terminal hole portions 42*c*, 42*d* in the first embodiment. Furthermore, a backstop hole portion which houses the backstop end portion 43*d* is formed in the first side portion $\mathbf{62}a_1$. A position at which to place the backstop hole portion is the same as the position at which to place the backstop hole portion 42*e* in the first embodiment.

One second side surface $\mathbf{62}a_2$ of the fixed terminal fixation portion 62*a* comes into contact with an inner surface of the fixed terminal main body 602, or faces the inner surface of the fixed terminal main body 602 with a space in between, when the first fixed terminal 61*a* is combined with the fixed terminal fixation portion 62*a*. Thereby, as illustrated in FIG. 9, the second side surface $\mathbf{62}a_2$ is covered with the fixed terminal main body 602 of the first fixed terminal 61*a*. This is the case with the other second side surface $\mathbf{62}a_2$ as well.

Furthermore, the shape of a support 62*b* which continues to the fixed terminal fixation portion 62*a*, and which is combined with the flange 11 of the coil bobbin 23, is changed from the shape of the support 42*b* in the first embodiment, in accordance with the positions of the terminal portions 602*a*.

The positions at which to place the terminal portions 602*a* in this embodiment are different from that in the first embodiment. However, the basic shapes of the fixed terminals 61, the configuration of the backstop 43, and the like in this embodiment are not largely changed from those in the first embodiment. For this reason, this embodiment brings about the same effects as does the first embodiment.

Fourth Embodiment

Next, descriptions will be provided for an electromagnetic relay according to a fourth embodiment. In the third embodiment, the first and second fixed terminals 61*a*, 61*b* include their respective terminal arm portions 603, and are fixed to the fixed terminal fixation portion 62*a* by letting the terminal arm portions 603 housed into the terminal hole portions 62*c*, 62*d* formed in the fixed terminal fixation portion 62*a*. Here, the terminal hole portions 62*c*, 62*d* are adjacent to each other, and are placed in a Y-direction center area of the fixed terminal fixation portion 62*a*. In addition, the openings of the terminal hole portions 62*c*, 62*d* each have the shape which is elongated in the Z direction while matching the shape of the terminal arm portion 603. However, the present disclosure is not limited to these. The shapes of the terminal arm portions of the fixed terminals, and the shapes of the terminal hole portions in the fixed terminal fixation portion into which the terminal arm portions are housed may be further modified.

Figure 12:
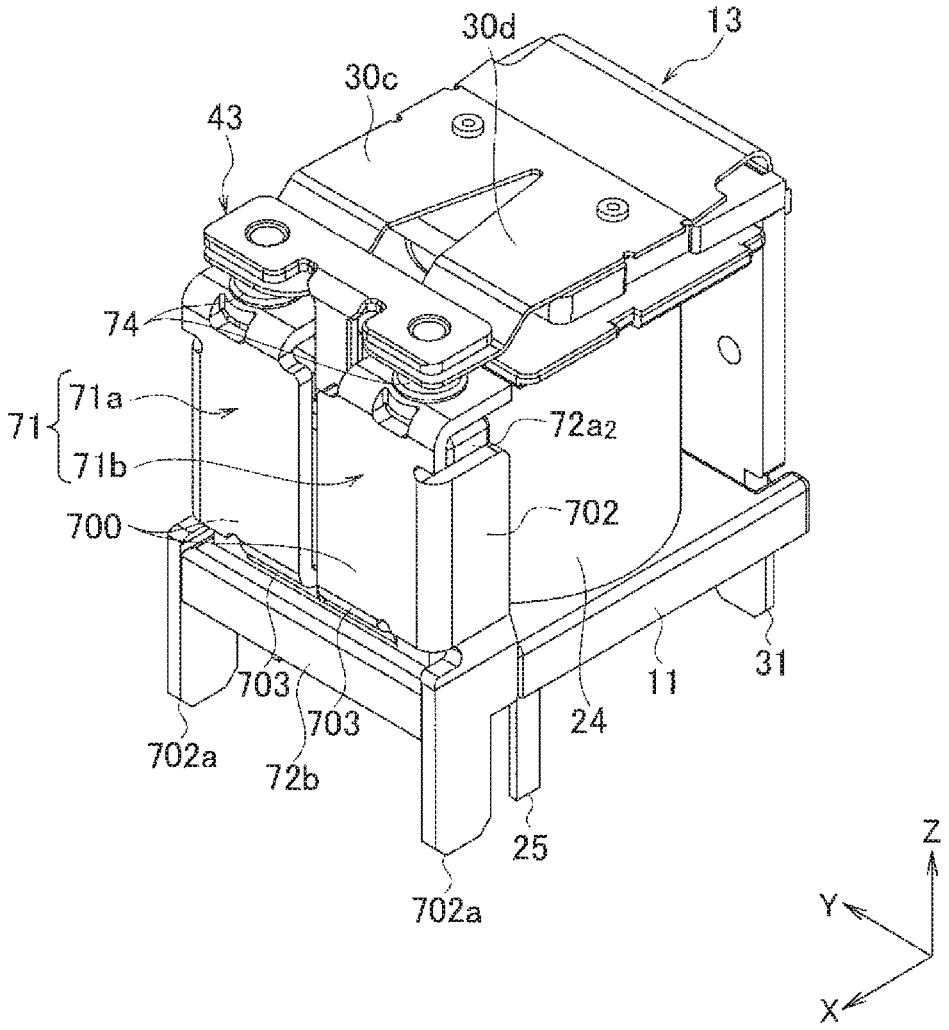
FIG. 12 is a view illustrating an internal configuration of the electromagnetic relay according to an embodiment.

FIG. 12 is a perspective view illustrating an internal configuration of the electromagnetic relay according to the fourth embodiment. Incidentally, FIG. 12 corresponds to FIG. 9 which illustrates the internal configuration of the electromagnetic relay according to the third embodiment. In FIG. 12, the same components as those in the electromagnetic relay according to the third embodiment are denoted by the same reference signs. Descriptions for such components will be omitted. To put it specifically, the shapes of second terminal arm portions 703 of fixed terminals 71 and terminal hole portions 72*c*, 72*d* of a fixed terminal fixation portion 72*a* in the electromagnetic relay according to the fourth embodiment are different from those of the terminal arm portion 603 and the terminal hole portions 62*c*, 62*d* in the electromagnetic relay according to the third embodiment.

Figure 13:
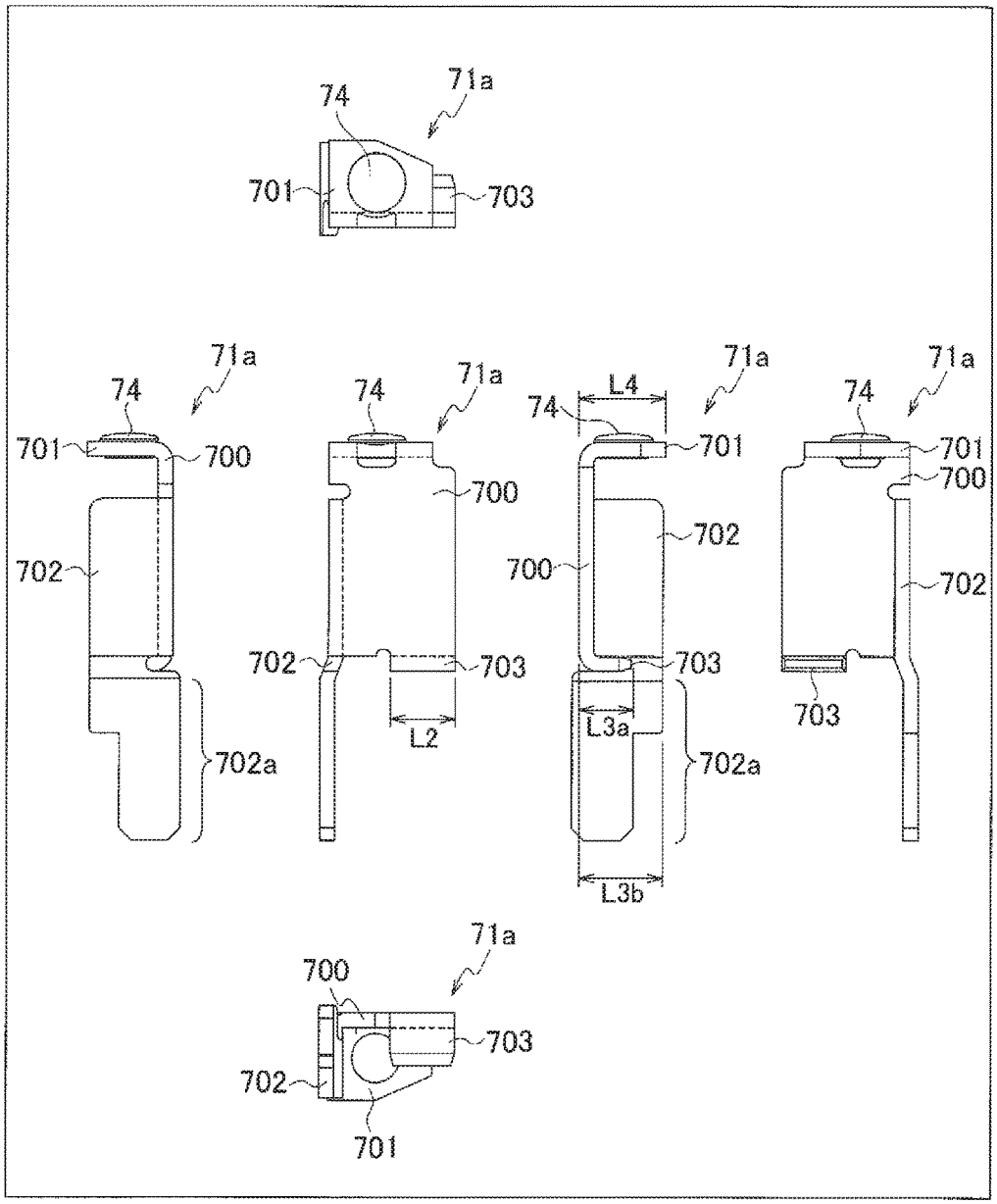
FIG. 13 is view illustrating a shape of a fixed terminal in the embodiment.

FIG. 13 is a view illustrating a shape of a first fixed terminal 71*a*. Incidentally, the drawings in FIG. 13 correspond to the drawings in FIG. 10 which illustrates the shape of the first fixed terminal 61*a* according to the third embodiment. Like the first fixed terminal 61*a* according to the third embodiment, the first fixed terminal 71*a* includes four flat plate portions. In the first fixed terminal 61*a*, the fixed terminal arm portion 600 includes the terminal arm portion 603 whose main plane is the XZ plane, and which continues to the Y-direction minus-side second edge of the fixed terminal arm portion 600. In contrast to this, a fixed terminal arm portion 700 of this embodiment includes a second terminal arm portion 703 instead of the terminal arm portion 603. The second terminal arm portion 703 is a flat plate portion whose main plane is an XY plane, and which curves from the lower edge of the fixed terminal arm portion 700 as a first side terminal portion to the minus side in the X direction. Incidentally, the dimensions of the flat plate portions included in the first fixed terminal 71*a* are the same as those of the flat plate portions included in the first fixed terminal 61*a* of the third embodiment.

Figure 14:
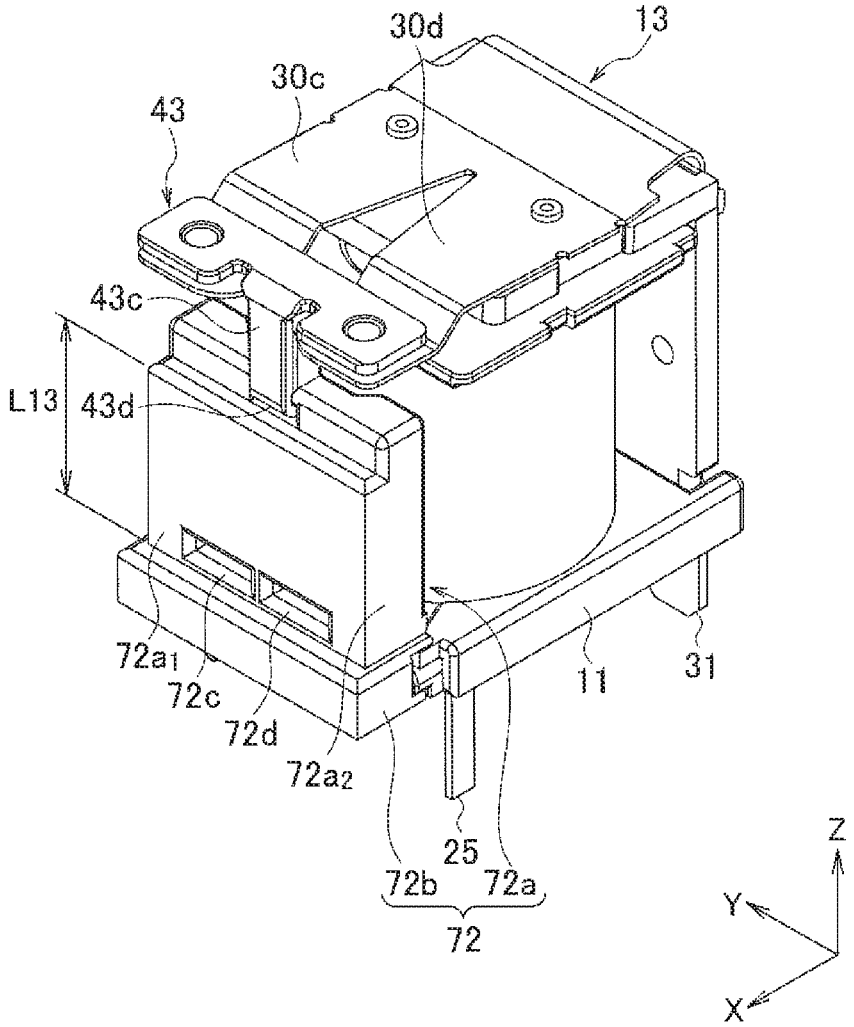
FIG. 14 is a view of the internal configuration illustrated in FIG. 12, exclusive of the fixed terminals.

FIG. 14 is a perspective view illustrating the internal configuration of the electromagnetic relay illustrated in FIG. 12, from which the first and second fixed terminals 71*a*, 71*b* are excluded for the explanation sake.

The basic shape of a fixed terminal retainer 72, inclusive of the dimensions of its various portions, is the same as that of the fixed terminal retainer 62 of the third embodiment. However, terminal hole portions 72*c*, 72*d* in which to house the second terminal arm portions 703 are adjacent to each other, and are placed in a Y-direction center area of a fixed terminal fixation portion 72*a*. In addition to this, the openings of the terminal hole portions 72*c*, 72*d* each have a shape which is elongated in the Y direction while matching the shape of the second terminal arm portion 703.

The shapes of the second terminal arm portions 703 and the terminal hole portions 72*c*, 72*d* in this embodiment are different from those in the third embodiment. However, the basic shapes of the fixed terminals 71, the configuration of the backstop 43, and the like in this embodiment are not largely changed from those in the first embodiment. For this reason, this embodiment brings about the same effects as does the first embodiment.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

The entire contents of Japanese Patent Application No. 2016-242262 (filed on Dec. 14, 2016) and Japanese Patent Application No. 2017-200183 (filed on Oct. 16, 2017) are incorporated herein by reference.

The invention claimed is:

1. An electromagnetic relay comprising:

an electromagnetic device including a coil;

a fixed terminal including a fixed terminal main body extending in a first direction, a fixed terminal arm portion curving and continuing from an edge of the fixed terminal main body, and two fixed contacts;

a movable spring including two movable contacts which come into or out of contact with the two fixed contacts, extending in a second direction, and being movable by drive of the electromagnetic device;

a backstop including a restraint portion provided contactable to a surface opposite from a contact abutment-side surface, an arm portion provided with the restraint portion, and a leg portion curving from the arm portion to a contact-abutment side in the first direction; and a fixed terminal retainer which retains the fixed terminal and the backstop, wherein one of the fixed terminal main body and the fixed terminal arm portion is a first side terminal portion facing in the second direction, another of the fixed terminal main body and the fixed terminal arm portion is a second side terminal portion curving from a first edge of the first side terminal portion in a direction opposite to the second direction, and the leg portion of the backstop is provided away from the first side terminal portion in the direction opposite to the second direction, and provided between the two movable contacts on a projection plane with a perpendicular extending in the second direction when viewed from the first direction.

2. The electromagnetic relay according to claim 1, wherein the fixed terminal retainer includes a backstop hole portion in which to house a backstop end portion which is provided to one end of the leg portion of the backstop.

3. The electromagnetic relay according to claim 2, wherein the backstop end portion curves from the one end of the leg portion of the backstop in the direction opposite to the second direction.

4. The electromagnetic relay according to claim 1, wherein the fixed terminal includes a terminal arm portion which curves from a second edge of the first side terminal portion in the direction opposite to the second direction, the second edge being opposite to the first edge, and the fixed terminal retainer includes a terminal hole portion in which to house the terminal arm portion.

5. The electromagnetic relay according to claim 2, wherein on the projection plane with the perpendicular extending in the second direction, the backstop end portion and the backstop hole portion are provided between the two movable contacts when viewed from the first direction.

6. The electromagnetic relay according to claim 2, wherein on the projection plane with the perpendicular extending in the second direction, the backstop hole portion is provided overlapping the first side terminal portion when viewed from the first direction.

7. The electromagnetic relay according to claim 2, wherein a plurality of the backstop end portions and a plurality of the backstop hole portions are provided along a line in which the two movable contacts are arranged side by side.

8. The electromagnetic relay according to claim 7, wherein on the projection plane with the perpendicular extending in the second direction, at least one of the backstop hole portions is provided overlapping the first side terminal portion when viewed from the first direction.

9. The electromagnetic relay according to claim 1, wherein the movable spring has two movable divided portions in its one end, the two movable divided portions obtained by dividing the one end of the movable spring in the second direction, the two movable divided portions each including a corresponding one of the two movable contacts, and the leg portion of the backstop is arranged between the two movable divided portions when viewed from the first direction.

10. The electromagnetic relay according to claim 4, wherein an opening of the backstop hole portion is placed off an opening of the terminal hole portion in the first direction.

11. The electromagnetic relay according to claim 4, wherein at least part of the leg portion of the backstop overlaps the terminal arm portion when viewed from an axis extending in a third direction which intersects the first direction and the second direction.

12. The electromagnetic relay according to claim 4, wherein the fixed terminal arm portion is longer in the first direction than the terminal arm portion.

13. The electromagnetic relay according to claim 1, wherein the fixed terminal main body is the first side terminal portion, and the fixed terminal arm portion is the second side terminal portion which covers a side surface of the fixed terminal retainer.

14. The electromagnetic relay according to claim 1, wherein the fixed terminal main body is the second side terminal portion which covers a side surface of the fixed terminal retainer, and the fixed terminal arm portion is the first side terminal portion.

15. The electromagnetic relay according to claim 13, wherein the fixed terminal arm portion includes a second terminal arm portion, and the second terminal arm portion curves from a lower edge of the first side terminal portion in the direction opposite to the second direction, and is housed in a terminal hole portion formed in the fixed terminal retainer.

16. The electromagnetic relay according to claim 1, wherein the fixed terminal includes a first fixed terminal and a second fixed terminal each including a corresponding one of the two fixed contacts, and when the two movable contacts are opened away from the two fixed contacts, the first fixed terminal and the second fixed terminal are not electrically connected to each other.

17. The electromagnetic relay according to claim 1, further comprising:

a cover which houses the electromagnetic device, and which includes a ceiling wall and side walls surrounding the ceiling wall, and a ventilation hole provided to the ceiling wall of the cover, wherein the ventilation hole is provided between the leg portion of the backstop and one of the side walls of the cover which is adjacent to the leg portion, when viewed from the first direction.

* * * * *